US007247001B2

(12) United States Patent
Kajiwara et al.

(10) Patent No.: US 7,247,001 B2
(45) Date of Patent: Jul. 24, 2007

(54) IMPELLER

(75) Inventors: Kenichi Kajiwara, Tokyo (JP); Sou Kuroiwa, Tokyo (JP); Kikuichi Mori, Tokyo (JP); Koichi Kunimasa, Tokyo (JP)

(73) Assignee: Ebara Corporation, Tokyo (JP)

( * ) Notice: Subject to any disclaimer, the term of this patent is extended or adjusted under 35 U.S.C. 154(b) by 115 days.

(21) Appl. No.: 10/501,886

(22) PCT Filed: Jan. 21, 2003

(86) PCT No.: PCT/JP03/00463

§ 371 (c)(1),
(2), (4) Date: Jul. 20, 2004

(87) PCT Pub. No.: WO03/062646

PCT Pub. Date: Jul. 31, 2003

(65) Prior Publication Data

US 2005/0002789 A1 Jan. 6, 2005

(30) Foreign Application Priority Data

Jan. 21, 2002 (JP) ..... 2002-012186

(51) Int. Cl.
*F04D 29/18* (2006.01)
*F04D 29/24* (2006.01)

(52) U.S. Cl. ..... 416/186 R; 416/228; 416/223 B; 416/198 R; 415/199.1

(58) Field of Classification Search ..... 416/186 R, 416/185, 228, 223 R, 223 B, 198 R; 415/199.2, 415/199.1, 90
See application file for complete search history.

(56) References Cited

U.S. PATENT DOCUMENTS

| | | | | |
|---|---|---|---|---|
| 2,228,750 | A * | 1/1941 | Brock | 55/403 |
| 3,265,001 | A * | 8/1966 | Deters | 415/68 |
| 3,440,968 | A * | 4/1969 | Jensen | 415/199.3 |
| 3,884,595 | A * | 5/1975 | Herrick | 416/198 R |
| 4,278,399 | A * | 7/1981 | Erickson | 415/199.1 |
| 4,363,601 | A | 12/1982 | Leskinen | |
| 4,428,717 | A * | 1/1984 | Catterfeld | 416/186 R |
| 4,647,271 | A * | 3/1987 | Nagai et al. | 416/186 R |
| 5,234,317 | A | 8/1993 | Kajiwara et al. | |
| 5,328,332 | A * | 7/1994 | Chiang | 416/186 R |
| 5,336,050 | A * | 8/1994 | Guida et al. | 416/186 R |
| 6,220,819 | B1 * | 4/2001 | Chien et al. | 416/186 R |
| 6,439,835 | B1 * | 8/2002 | Chien et al. | 415/104 |

FOREIGN PATENT DOCUMENTS

| | | |
|---|---|---|
| EP | 0 055 426 | 7/1982 |
| JP | 55-104599 | 8/1980 |
| JP | 6-221299 | 8/1994 |
| JP | 7-191195 | 1/1995 |
| JP | 7-18437 | 3/1995 |
| JP | 7-38694 | 7/1995 |

* cited by examiner

*Primary Examiner*—Ninh H. Nguyen
(74) *Attorney, Agent, or Firm*—Westerman, Hattori, Daniels & Adrian, LLP.

(57) ABSTRACT

An impeller (1) according to the present invention has a disk-like main plate (10), a blade (20) joined to the main plate, and a side plate (30) having a suction port. A boss hole (12) is formed in a central portion of the main plate for attaching a boss which engages with a pump shaft to the boss hole. A step portion (14) is formed around the boss hole, which is formed in the main plate, by drawing.

8 Claims, 3 Drawing Sheets

IMPELLER

TECHNICAL FIELD

The present invention relates to an impeller used for a pump or the like, and more particularly to an impeller manufactured by press-forming a sheet metal material.

BACKGROUND ART

Impellers used for a pump or the like are mostly manufactured by welding parts, into which a sheet metal material is press-formed, with an automatic welding machine. FIG. 5 is a schematic cross-sectional view of a conventional impeller. As shown in FIG. 5, the impeller 100 is composed of a disk-like main plate 110, blades 120 joined to the main plate 110, and a side plate 130 having a suction port.

A sheet metal material is die-cut and press-formed to produce the blades 120 of the impeller 100, and then the blades 120 of the impeller 100 are joined to the main plate 110 by welding. However, in the conventional impeller, as shown in FIG. 5, radially inner end portions 122 of the blades 120 which are joined to the main plate 110 are so sharp that a large load is applied to a die portion to die-cut the radially inner end portions 122, and that the die portion is worn away in a short term.

Further, when the respective parts are joined to each other with an automatic welding machine, as shown in FIG. 6, main plates 110 are piled on one another before blades 120 are joined to the main plates 110. Each one of piled main plates 110 is raised, transferred, and welded by the automatic welding machine. However, in the conventional impeller, since the main plate 110 is of a flat disk, adjacent main plates are adhered and attracted to each other in the case where the main plates are piled on one another as described above. Accordingly, when each one of the main plates 110 is to be raised, an adjacent main plate is also raised and transferred together to cause problems such as error interruption of the welding machine.

DISCLOSURE OF INVENTION

The present invention has been made in view of the above drawbacks of the prior art. It is, therefore, an object of the present invention to provide an impeller which can prolong a lifetime of a die for forming a blade and prevent error interruption of a welding machine to enhance productivity.

In order to solve the above drawbacks of the prior art, according to a first aspect of the present invention, there is provided an impeller having a disk-like main plate, a blade joined to the main plate, and a side plate having a suction port, characterized in that a boss hole is formed in a central portion of the main plate for attaching a boss which engages with a pump shaft to the boss hole, wherein a step portion is formed around the boss hole, which is formed in the main plate, by drawing.

Thus, since a step portion is formed around a boss hole, a gap is formed between adjacent main plates when the main plates are piled on one another. Therefore, even when the main plates are piled on one another before the blade is joined to the main plates, a gap is formed between adjacent main plates to thereby prevent these main plates from being adhered or attracted to each other. Thus, adjacent main plates are prevented from being raised together, and error interruption of a welding machine is prevented to enhance productivity of impellers.

In this case, it is desirable that when a plurality of main plates are piled on one another, a gap formed by the step portions of adjacent main plates be set to be in a rage of 0.3 mm to 0.4 mm.

According to a second aspect of the present invention, there is provided an impeller having a disk-like main plate, a blade joined to the main plate, and a side plate having a suction port, characterized in that a radially inner end portion of the blade which is joined to the main plate is rounded.

Thus, a radially inner end portion of the blade which is joined to the main plate is rounded. Accordingly, when the blade is formed by die-cutting a sheet metal material, no large loads are applied to a die portion to die-cut the radially inner end portion. Thus, it is possible to reduce abrasion of the die portion. Therefore, it is possible to prolong a lifetime of the die portion and enhance productivity of impellers.

According to the present invention, there is provided a multistage pump characterized by comprising a plurality of intermediate casings, the aforementioned impellers housed in respective intermediate casings, and a main shaft for supporting the impellers.

BEST MODE FOR CARRYING OUT THE INVENTION

Figure 1:
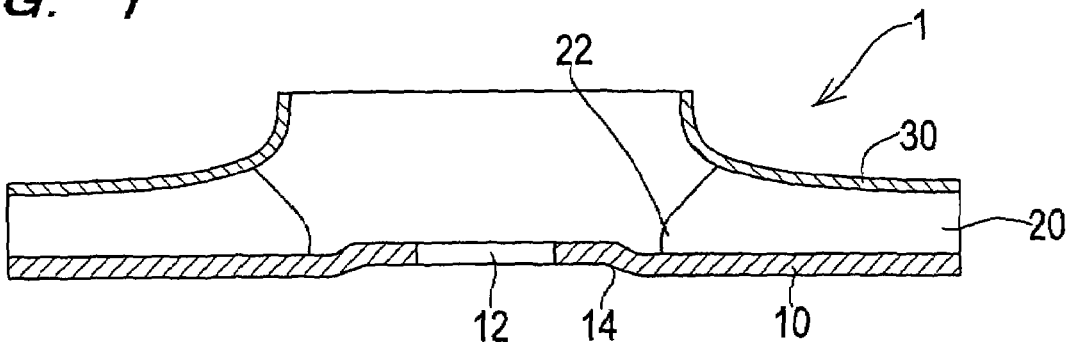
FIG. 1 is a vertical cross-sectional view showing an impeller according to an embodiment of the present invention.

An impeller according to an embodiment of the present invention will be described below in detail with reference to FIGS. 1 through 3. FIG. 1 is a vertical cross-sectional view showing an impeller according to an embodiment of the present invention, FIG. 2 is a schematic view showing a state in which main plates of impellers according to an embodiment of the present invention are piled on one another, and FIG. 3 is a partial enlarged view of FIG. 2.

As shown in FIG. 1, an impeller 1 has a main plate 10, blades 20 joined to the main plate 10, and a side plate 30 having a suction port. A sheet metal material such as stainless steel is die-cut into a disk-like shape to form the main plate 10. A boss hole 12 is formed in a central portion of the main plate 10 for attaching a boss which engages with a pump shaft to the boss hole. Drawing is carried out by a press to form a step portion 14, which is raised upward, around the boss hole 12. As shown in FIG. 3, the step portion 14 comprises a sharp angle portion on a surface of the main plate and a slant portion on an opposite surface of the main plate, wherein the slant portion having a smaller angle than that of the sharp angle portion.

Figure 2:
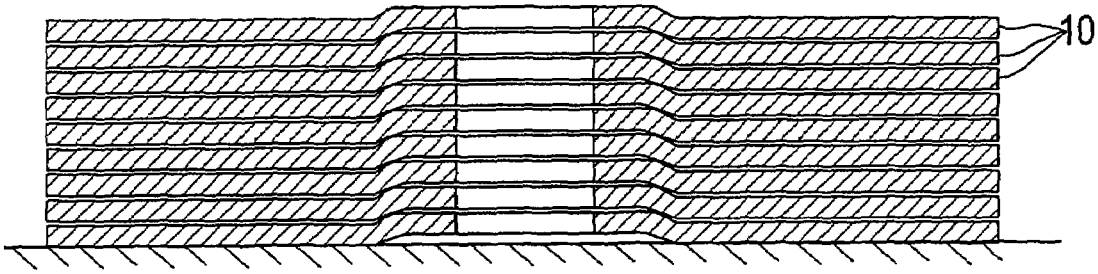
FIG. 2 is a schematic view showing a state in which main plates of impellers according to an embodiment of the present invention are piled on one another.
Figure 3:
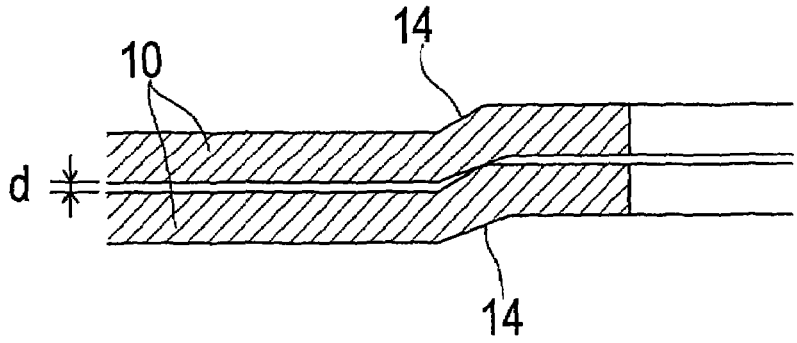
FIG. 3 is a partial enlarged view of FIG. 2.

Since the step portion 14 is thus formed around the boss hole 12, as shown in FIGS. 2 and 3, when the main plates 10 are piled on one another, a gap d is formed between adjacent main plates 10. Therefore, even when the main plates 10 are piled on one another before the blades 20 are joined to the main plates 10, a gap d is formed between adjacent main plates 10 to thereby prevent these main plates 10 from being adhered or attracted to each other. Thus, adjacent main plates 10 are prevented from being raised together, and error interruption of a welding machine is prevented to enhance productivity of impellers.

Here, if the gap d is excessively large, then relating dimensions of other parts are also changed. Therefore, it is necessary to minimize the gap. From this point of view, it is desirable that the gap d be set to be in a range of 0.3 mm to 0.4 mm.

In the present embodiment, as shown in FIG. 1, radially inner end portions 22 of the blades 20 which are joined to the main plate 10 are rounded. Accordingly, when the blades 20 are formed by die-cutting a sheet metal material, no large loads are applied to a die portion to die-cut the radially inner end portions 22. Thus, it is possible to reduce abrasion of the die portion. Therefore, it is possible to prolong a lifetime of the die portion and enhance productivity of impellers. Although there has been described in the present embodiment an example in which the radially inner end portions 22 are rounded, the radially inner end portions 22 may be formed so as to have an obtuse angle.

Next, a multistage pump using impellers, as shown in FIG. 1, according to the present invention will be described with reference to FIG. 4.

Figure 4:
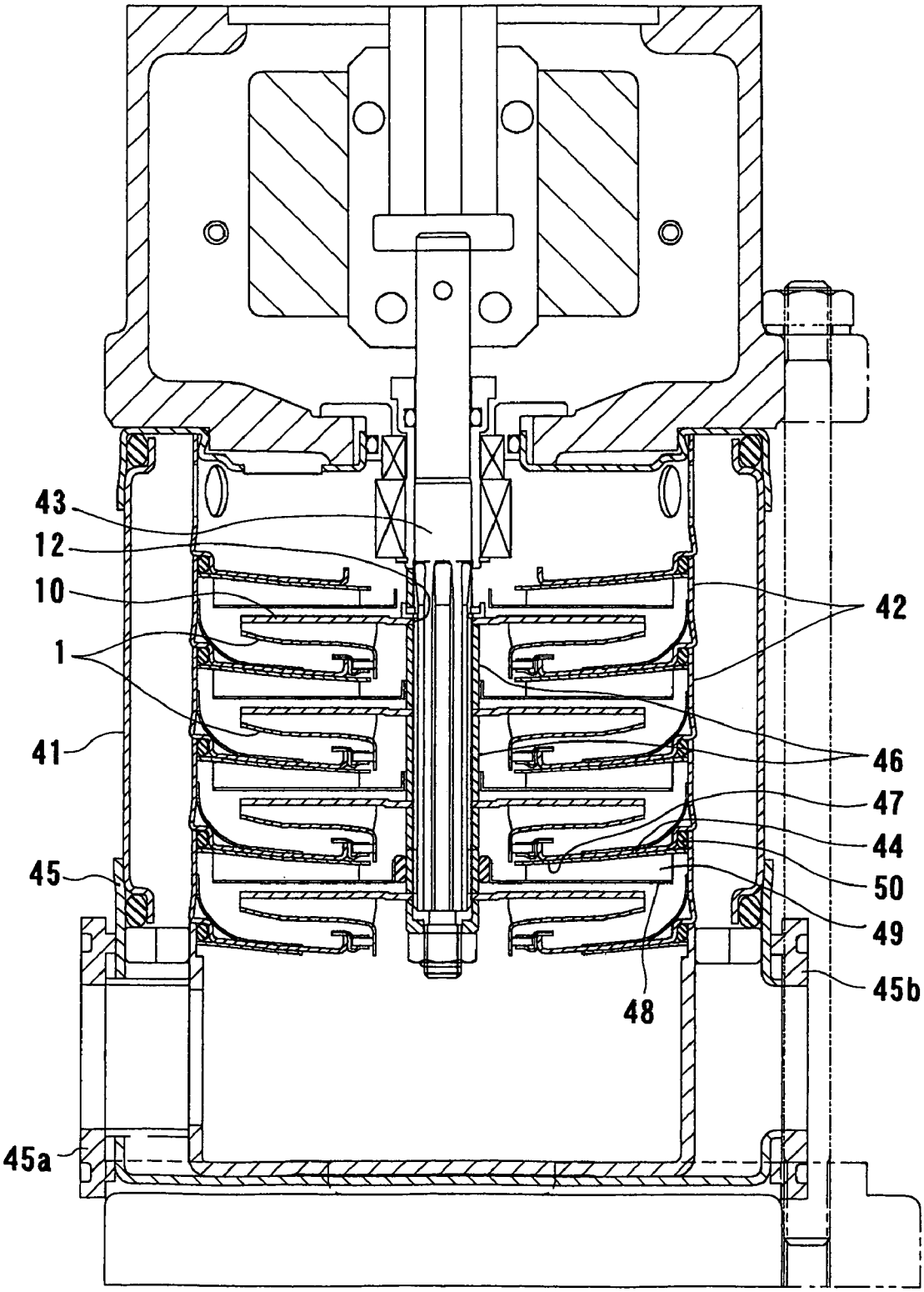
FIG. 4 is a vertical cross-sectional view showing a multistage pump using impellers according to the present invention.
Figure 5:
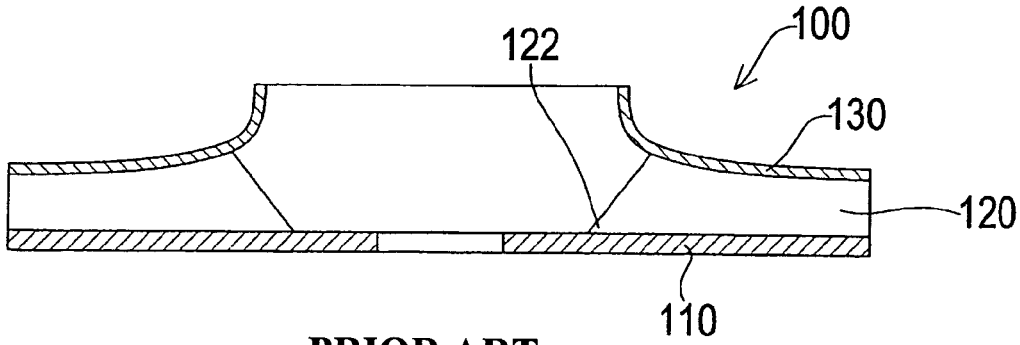
PRIOR ART FIG. 5
FIG. 5 is a vertical cross-sectional view showing a conventional impeller.
Figure 6:
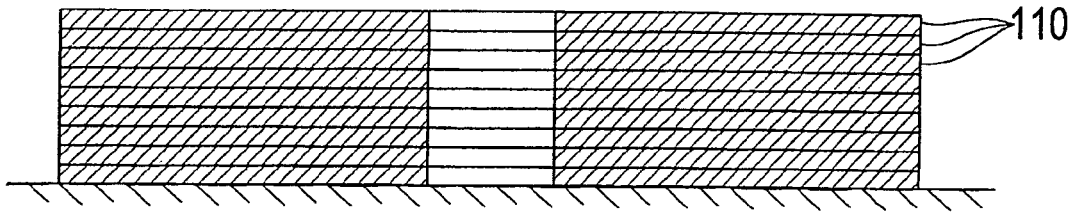
PRIOR ART FIG. 6
FIG. 6 is a schematic view showing a state in which main plates of conventional impellers are piled on one another.

FIG. 4 is a vertical cross-sectional view showing a multistage pump using impellers according to the present invention. In the multistage pump according to the present embodiment, a plurality of intermediate casings 42 connected to each other is housed in an outer casing 41, and impellers 1 attached to a main shaft 43 are housed in respective intermediate casings 42. A lower casing 45 is connected to a lower end portion of the outer casing 41. The lower casing 45 has a suction port 45*a* and a discharge port 45*b*. An impeller attachment portion of the main shaft 43 comprises a spline shaft portion and has a plurality of keyways formed in parallel to an axial portion. Meanwhile, a groove into which the spline shaft portion is fitted is formed in the boss hole 12 of the main plate 10 of the impeller 1. Thus, the impellers 1 are attached to the main shaft 43 by spline fitting. Distance pieces 46 are disposed between preceding and subsequent stages of the impellers 1 so as to be fitted into the spline shaft portion of the main shaft 43.

The intermediate casing 42 is formed substantially into a cylindrical receptacle. The intermediate casing 42 is produced by press-forming a steel plate. A relief plate 47 is attached to a bottom portion 44 of each of the intermediate casings 42 by welding. Return vanes 49 are interposed between the relief plate 47 and a side plate 48 and attached to the relief plate 47 and the side plate 48 by welding. The relief plate 47 and the adjacent intermediate casing 42 form a space in which an O-ring 50 is fitted.

With the above arrangement, during operation of the pump, a pumping liquid drawn from the suction port 45*a* of the lower casing 45 is pressurized by the impellers 1 rotated by the main shaft 43. The pressurized pumping liquid is introduced into a suction portion of a subsequent impeller 1 through a passage formed by the return vanes 49 interposed between the relief plate 47 and the side plate 48. Thus, the pumping liquid is pressurized by each stage of the impellers 1, recovered in pressure while flowing through a passage formed by each stage of the return vanes 49, and finally discharged from the discharge port 45*b* of the lower casing 45 to the exterior of the pump.

While the present invention has been described with reference to the embodiment thereof, the present invention is not limited to the above embodiment. Thus, it would be apparent that various modifications may be made therein without departing from the technical concept of the present invention.

As described above, according to the present invention, since a step portion is formed around a boss hole, a gap is formed between adjacent main plates when the main plates are piled on one another. Therefore, even when the main plates are piled on one another before the blade is joined to the main plates, a gap is formed between adjacent main plates to thereby prevent these main plates from being adhered or attracted to each other. Thus, adjacent main plates are prevented from being raised together, and error interruption of a welding machine is prevented to enhance productivity of impellers.

Further, a radially inner end portion of the blade which is joined to the main plate is rounded. Accordingly, when the blade is formed by die-cutting a sheet metal material, no large loads are applied to a die portion to die-cut the radially inner end portion. Thus, it is possible to reduce abrasion of the die portion. Therefore, it is possible to prolong a lifetime of the die portion and enhance productivity of impellers.

INDUSTRIAL APPLICABILITY

The present invention can suitably be used for an impeller manufactured by press-forming a sheet metal material.

The invention claimed is:

1. An impeller having a disk-like main plate, a blade joined to said main plate, and a side plate having a suction port, characterized in that:

a boss hole is formed in a central portion of said main plate for attaching a boss which engages with a pump shaft to said boss hole, wherein a the step portion is formed around the boss hole, which is formed in said main plate by drawing, said step portion constituting means for forming a gap so that when a plurality of main plates are piled on one another, said gap is formed by only contacting said step portions of adjacent main plates to each other to thereby prevent said adjacent main plates from being adhered to each other, wherein the step portion comprises a sharp angle portion on a surface of the main plate and a slant portion on an opposite surface of the main plate, and wherein the slant portion having a smaller angle than that of the sharp angle portion.

2. The impeller as recited in claim 1, characterized in that when said gap is set to be in a rage of 0.3 mm to 0.4 mm.

3. A multistage pump characterized by comprising a plurality of intermediate casings, impellers, as recited in claim 2, housed in respective intermediate casings, and a main shaft for supporting said impellers.

4. A multistage pump characterized by comprising a plurality of intermediate casings, impellers, as recited in claim 1, housed in respective intermediate casings, and a main shaft for supporting said impellers.

5. The impeller having a disk-like main plate according to claim 1, wherein the main plate is a single piece of molded metal.

6. An impeller having a disk-like main plate, a blade joined to said main plate, and a side plate having a suction port, characterized in that:

a boss hole is formed in a central portion of said main plate for attaching a boss which engages with a pump shaft to said boss hole, wherein a step portion is formed around the boss hole, which is formed in said main plate by drawing, said step portion constituting means for forming a gap so that when a plurality of main plates are piled on one another, said gap is formed by only contacting said step portions of adjacent main plates to each other to thereby prevent said adjacent main plates from being adhered to each other;

wherein the step portion comprises a sharp angle portion on a surface of the main plate and a slant portion on an opposite surface of the main plate, wherein the slant portion having a smaller angle than that of the sharp angle portion; and a radially inner end portion of said blade which is joined to said main plate is rounded near a portion at which said blade is joined to said main plate.

7. A multistage pump characterized by comprising a plurality of intermediate casings, impellers, as recited in claim 6, housed in respective intermediate casings, and a main shaft for supporting said impellers.

8. The impeller having a disk-like main plate according to claim 6, wherein the main plate is a single piece of molded metal.

* * * * *

UNITED STATES PATENT AND TRADEMARK OFFICE

CERTIFICATE OF CORRECTION

PATENT NO. : 7,247,001 B2
APPLICATION NO. : 10/501886
DATED : July 24, 2007
INVENTOR(S) : Kenichi Kajiwara et al.

It is certified that error appears in the above-identified patent and that said Letters Patent is hereby corrected as shown below:

<u>In Column 4, Line 39 Claim 1</u>:

In claim 1 line 39 please change "wherein a the step portion is formed around the boss hole," to --wherein a step portion is formed around the boss hole,--.

Signed and Sealed this

Eighteenth Day of December, 2007

JON W. DUDAS
*Director of the United States Patent and Trademark Office*